US009765410B2

(12) United States Patent
Petit et al.

(10) Patent No.: US 9,765,410 B2
(45) Date of Patent: Sep. 19, 2017

(54) PROCESS FOR PURIFYING BEET JUICE

(71) Applicant: LESAFFRE ET COMPAGNIE, Paris (FR)

(72) Inventors: Eric Petit, Marquette lez Lille (FR); Marie-Yannick Sarrazyn, Bachy (FR)

(73) Assignee: LESAFFRE ET COMPAGNIE, Paris (FR)

( * ) Notice: Subject to any disclaimer, the term of this patent is extended or adjusted under 35 U.S.C. 154(b) by 0 days.

(21) Appl. No.: 14/651,342

(22) PCT Filed: Dec. 16, 2013

(86) PCT No.: PCT/FR2013/053095

§ 371 (c)(1),
(2) Date: Aug. 17, 2015

(87) PCT Pub. No.: WO2014/096656

PCT Pub. Date: Jun. 26, 2014

(65) Prior Publication Data

US 2016/0060719 A1 Mar. 3, 2016

(30) Foreign Application Priority Data

Dec. 18, 2012 (FR) ..... 12 62221

(51) Int. Cl.
*C13B 20/16* (2011.01)
*C13B 20/00* (2011.01)

(52) U.S. Cl.
CPC ..... *C13B 20/165* (2013.01); *C13B 20/00* (2013.01); *C13B 20/16* (2013.01)

(58) Field of Classification Search
CPC ..... C13B 20/165
See application file for complete search history.

(56) References Cited

U.S. PATENT DOCUMENTS 4,187,120 A 2/1980 Kunin et al.
4,238,334 A * 12/1980 Halbfoster ..... B01D 37/03 210/504
4,572,742 A * 2/1986 Kunin ..... C13B 20/12 127/46.2
5,554,227 A * 9/1996 Kwok ..... C13B 20/02 127/46.2
5,891,254 A 4/1999 Coville et al.
6,615,991 B1 * 9/2003 Rettenmaier ..... B01D 37/02 210/488
2010/0285189 A1 * 11/2010 Schoelkopf ..... B01J 20/10 426/271
2011/0039011 A1 2/2011 Tierny
2014/0342444 A1 * 11/2014 Minamino ..... B01D 61/58 435/294.1

FOREIGN PATENT DOCUMENTS

| | | | |
|---|---|---|---|
| GB | 923 109 | | 4/1963 |
| GB | 987 945 | | 3/1965 |
| GB | 2 022 135 | | 12/1979 |
| JP | 2000-312881 | | 11/2000 |
| WO | 2009/125088 | | 10/2009 |
| WO | WO2013/039137 | * | 3/2013 |

OTHER PUBLICATIONS

Physicochemical Properties of Commercial Fibres From Different Sources: A Comparative Approach C.M. Rosell et al. pp. 1-32, 2009.*

MSDS for Becocel Eaton industries pp. 1-5, Aug. 6, 2015, downloaded Dec. 29, 2016.*

International Search Report dated Feb. 19, 2014, which issued during prosecution of International Application No. PCT/FR2013/053095.

* cited by examiner

*Primary Examiner* — Douglas B Call
(74) *Attorney, Agent, or Firm* — Vedder Price P.C.; Thomas J. Kowalski; Deborah L. Lu

(57) ABSTRACT

The present invention relates to a process for purifying beet sugar juice and more particularly sugar juice obtained by pressing beets. It also relates to the purified juice and to the uses thereof, in particular as a fermentation substrate and for preparing granulated sugar. The purification process according to the invention comprises a step of passing the juice to be treated through a cellulose-fibre-based pre-layer. This process can be improved when the juice to be treated comprises between 0.1% and 4% of cellulose fibres.

5 Claims, No Drawings

PROCESS FOR PURIFYING BEET JUICE

RELATED PATENT APPLICATIONS

The present application is filed pursuant to 35 U.S.C. §371 as a U.S. National Phase Application of International Patent Application No. PCT/FR2013/053095, filed on Dec. 16, 2013, which was published as PCT Publication No. WO 2014/096656 on Jun. 26, 2014 and claims the benefit of priority to French Patent Application No. FR 12 62221 filed on Dec. 18, 2012. The contents of the aforementioned Patent Applications are hereby incorporated by reference in their entirety.

The present invention relates to a process for purifying beet sugar juice and more particularly sugar juice obtained by pressing beets. It also relates to the purified juice and to the uses thereof, in particular as a fermentation substrate and for preparing granulated sugar.

Beet sugar juices are generally obtained by means of an extraction process denoted "diffusion extraction". This process can be summarized as follows: the sugar beets are first of all washed and then chopped into cossettes before passing into a large-capacity extractor in which hot water circulates countercurrentwise. Thus, the sugar contained in the cossettes passes into the water; this is known as diffusion. Once this step has been accomplished, two products emerge, the beet pulps "which are depleted of sugar" and water loaded with sugar, also called diffusion juice which will need to be purified according to the lime-carbon separation process, in order to obtain a purified juice, concentrated in order to obtain a syrup and optionally crystallized in order to obtain granulated sugar.

The prior art reveals various processes for the extraction of a sugar juice for producing sugar. Thus, document NL-C2-1014605 describes a pressing of whole or chopped beets, it being possible for the pressed beets to be recovered as a feed for feeding animals and the sugar juice being intended for the production of sugar. Document EP 1063605 describes a process comprising only two steps of extraction by pressing of a mixture comprising fresh grated beet and a sugar juice additive. Document EP 1022342 describes a process for extracting a sugar juice comprising a multitude of pressing and extraction steps. These various processing processes result in the production, on the one hand, of beet pulps with a low sugar content and, on the other hand, of a dilute sugar juice.

WO 2009/125088 describes a process for processing beets comprising at least the following steps:

- washing of the beets;
- partial pressing of the beets for the production, on the one hand, of a press cake containing more than 20% sugar relative to the dry matter content and, on the other hand, of a sugar juice at a concentration greater than 15% dry matter content;
- separation of the press cake and of the sugar juice.

This processing process may also comprise, between the washing step and the pressing step, a step of chopping the beets.

The unpurified sugar juice, subsequently denoted JBT AE, obtained according to WO 2009/125088, is of considerable industrial value and can be used in various applications, in particular as a fermentation substrate. However, because of its relatively low sugar content, it needs to be concentrated.

However, the concentration of unpurified juice is judged to be unrealistic by those skilled in the sugar-producing art because of the absence of purification of the juice before evaporation, which can cause considerable fouling of evaporation tools. It should be pointed out that it had never previously been possible for an unpurified juice (in the sugar sense of the term) to be concentrated.

The inventors of the present invention, seeking to use the JBT AE in a certain number of applications, have encountered processing difficulties, in particular in applications requiring a filtration step. Indeed, it has been noted that the JBT AE comprises particles in suspension. These as yet unidentified particles disrupt the progress of the technical operations and make the usual filtration operations virtually impossible. These difficulties considerably limit the field of industrial use of the JBT AE.

The JBT AE to which the invention relates has a sludge level of between 8% and 20% depending on the beet preparation and pressing conditions. The sludge level, expressed as volume relative to 100 g of JBT AE, is calculated as described in example 1.

There is therefore a real need for a process for purifying and/or filtering the JBT AE.

The filtration purification tests carried out by the inventors of the present invention have shown that microfiltration and/or ultrafiltration appear to be sufficient for removing the deposit of which the molecular size is in the region of one micron. However, the filtration flow rates for the membranes used (1.4 microns, 0.45 microns and 300 kDa) are very low and remain disadvantageous for industrial uses.

After numerous tests, the inventors have shown that the use of cellulose fibers in the filtration processes makes it possible to considerably reduce the amount of particles deposited.

Indeed, it has been noted that filtration of the JBT AE on a rotary filter with a cellulose-fiber-based scraped precoat makes it possible to obtain a sugar juice (filtrate) which, after concentration, results in very little deposit.

It has also been noted that the addition of cellulose fibers to the JBT AE significantly improves the filtration.

Furthermore, it is known that matter in suspension can be removed by means of centrifugation operations. In the present case, centrifugation is effective only at very high speeds.

The inventors of the present invention have noted that the centrifugation performance levels are improved when the JBT AE to be centrifuged comprises cellulose fibers.

The first subject of the invention is a process for filtering beet sugar juice, comprising a step of passing said juice through a precoat comprising cellulose fibers.

According to one form of the invention, the precoat consists of 100% of cellulose fibers.

According to the invention, the filtration may be filtration on a scraped precoat rotary filter or frontal filtration.

The term "frontal filtration" is intended to mean vertical flow of the product to be filtered through a filter.

The inventors have also noted that the filtration, whether it is frontal or by means of a precoat rotary filter, can be considerably improved if the cellulose fibers are added to the JBT AE. The amount of fibers to be added to the JBT AE is between 0.1% and 4% by weight and preferentially between 0.2% and 3% by weight.

Another subject of the invention is the use of the beet juice as purified according to the process of the invention, as a fermentation substrate or as a raw material for producing granulated sugar.

The following examples illustrate the invention without limiting the scope thereof.

EXAMPLES

1. Determination of the Sludge Level:

The sludge level is evaluated by centrifugation according to the following protocol:

weight out 65 g of JBT AE and add 20 ml of water, adjust the pH to 6.5, add 100 ml of demineralized water, heat to 100° C. and maintain at boiling for 2 to 3 minutes, cool and then centrifuge for 15 minutes at 3700 rpm in 15 ml tubes.

The sludge content, expressed in ml/100 g, is calculated as follows:

ml lus×100×100/15×65.

2. Filtration of the JBT AE on a Scraped Precoat Rotary Filter

Two tests were carried out with two types of precoats:

a. Potato starch to which 10% of corn starch has been added;

b. Cellulose fibers known under the trade names ARBOCEL (Grade BER40) and VITACEL (Grade L600).

Since cellulose is temperature-resistant, unlike starch, the use of this raw material enables hot-filtration of the syrups.

Under our test conditions and in order to avoid dilution of the JBT AE filtrate with the water constituting the liquid ring of the vacuum pump of the filter, a filtrate recycling system was put in place. The filtrate could then be used as service liquid and thus eliminate the dilution with water.

After having filtered close to 80 to 100 liters of JBT AE, the tests were stopped and the filtrates were concentrated on a rotary evaporator. The sludge levels of the JBTs thus reconstituted were measured and are collated in the following table I. These JBTs were compared to a control corresponding to the JBT AE thawed and concentrated directly without any prior treatment.

TABLE I

Level of deposit measured on the JBTs that were concentrated after filtration of the JBT AE on a precoat

| Precoat type | Sludge level | Observation |
|---|---|---|
| Nonfiltered JBT AE control | 8% to 12% | Concentrated directly |
| Precoat consisting of 90% | 4% | Very rapid clogging of the |

TABLE I-continued

Level of deposit measured on the JBTs that were concentrated after filtration of the JBT AE on a precoat

| Precoat type | Sludge level | Observation |
|---|---|---|
| Alimentamyl modified potato starch + 10% corn starch | | precoat requiring regular scraping |
| Precoat based on cellulose fiber: 50% BER40 + 50% L600 | <1% | No clogging observed, no scraping |

The use of a precoat consisting of starch is not envisionable since the filtration of 100 kg of JBT AE led to the consumption of close to 3 kg of starch, i.e. a ratio of close to 10% W/W of starch per kg of JBT produced.

The use of cellulose appears, on the other hand, to be particularly advantageous since no scraping of the precoat was required, while the deposit measured on JBT was brought back from approximately 10% (control without treatment) to less than 1%.

3. Frontal Filtration of the JBT AE with Addition (Topping Up) of Cellulose Fibers Since the use of cellulose on the precoat filter made it possible to obtain a good reduction of the deposit present in the JBT AE, the tests consisting in topping up the JBT AE with cellulose were continued under various frontal filtration conditions.

This is because, since the use of the JBT AE on a rotary filter was difficult to manage, it was decided to work using frontal filtration with a cellulose precoat (Grade BER40) and topping up (2% W/W relative to juice) in order to simplify the implementation of the tests and thus to accelerate the rate thereof.

Three series of tests were carried out in order to estimate the advantage of a filtration of the JBT AE on a cellulose precoat.

The results of the various tests carried out are collated in table II hereinafter. The results should be compared to the internal control (JBT concentrated to L without any other treatment) and to the "Attin" controls (JBT produced at Attin from the same JBT AE).

Various test conditions were tested by varying:

the pH of the juice to be filtered;

the use of a flocculant (ALOES Alopolym 637) used at 10 ppm.

TABLE II

Tests of frontal filtration of various non-concentrated beet juices resulting from the ECOSAF pilot

| Test | Sample ref. | Filtration pH | Cellulose top up | Flocculant (Alopolym 637) | Duration concentration & final Brix | Level of deposit | Observation |
|---|---|---|---|---|---|---|---|
| S1.4 | JBT AE | 10.0 | no | no | 20 min, 62° Bx | 18% | Internal control |
| S1.6 | JBT AE | 4.0 | 2% | no | 20 min, 62° Bx | 9% | Reduction of the deposit via low pH and cellulose |
| S2.2 | JBT AE | 10.5 | 2% | no | 20 min, 67° Bx | 4 to 5% | Reduction of the deposit via cellulose |
| S2.3 | JBT AE | 10.5 | 2% | 10 ppm | 20 min, 67° Bx | 2% | |
| S2.4 | JBT AE | 4.2 | 2% | no | 20 min, 66° Bx | 1% | |
| S2.5 | JBT AE | 4.2 | 2% | 10 ppm | 20 min, 62° Bx | 2% | |

TABLE II-continued

Tests of frontal filtration of various non-concentrated beet juices resulting from the ECOSAF pilot

| Test | Sample ref. | Filtration pH | Cellulose top up | Flocculant (Alopolym 637) | Duration concentration & final Brix | Level of deposit | Observation |
|---|---|---|---|---|---|---|---|
| S3.2 | JBT AE | 9.2 | no | no | 20 min, 64° Bx | 8% | Internal control |
| S3.3 | JBT AE | 9.2 | 2% | 10 ppm | 20 min, 65° Bx | 0% | Reduction of the deposit via cellulose |

A cellulose precoat is deposited on the filter, the juice to be filtered being topped up with 2% of cellulose (Grade BER 40). After filtration, the filtrates were alkalinized if necessary to pH 10 and then concentrated on a rotary evaporator until a Brix close to 65% was obtained. The level of deposit was then measured.

The use of cellulose as an addition enabled a significant reduction in the level of sludge, said reduction being between 50% and approximately 90% of the initial deposit.

The monitoring of the filtration kinetics shows that the filtrations of the acidified JBT AEs prove to be more difficult than those of the alkaline JBT AEs.

These observations tend to show that the acidification of the JBT AE and/or the addition of flocculant cause(s) a loss of permeability of the filtration cake. This greater resistance to filtration perhaps also reflects a greater retention of impurities. The deposit levels measured in the filtered juices which have been acidified or to which flocculant has been added are effectively lower (1% to 2%) than in the case of filtration of the JBT AE at pH 10.5 without the addition of flocculant (deposit level approximately 4% to 5%).

The filtration on a cellulose precoat therefore clearly makes it possible to retain the deposit present in the JBT; the topping up of the JBT AE with cellulose makes it possible to facilitate the filtration by improving the filtration flow rates.

While this technique for purifying the JBT AE was retained, it was, however, advisable to continue the tests in order to specify the type of filter to be used and the top up parameters. The choice of the grade of cellulose fibers to be used could then be validated.

4. Centrifugation of the JBT AE with or without Cellulose Fiber Top Up

Various conditions for centrifugation of the JBT AE (C10) were studied on the Pilot floor-standing centrifuge (JOUAN KR4/22, RP6 6-bucket rotor, 0.8 kg of juice centrifuged per bucket).

The cellulose fibers (Grade BER 40) could be used for topping up the juices before centrifugation at an incorporation ratio ranging between 0.5% and 2% W/W. The contact time before centrifugation was set at a few minutes, which was the time for preparing the preparations.

The pH of the juice was not readjusted before use.

For each test, the supernatant of the juice centrifuged was carefully recovered so as not to resuspend the centrifugation pellet, and was then concentrated on a Pilot rotary evaporator.

It was possible to apply two supernatant concentration kinetics during these tests, namely:

- rapid and controlling kinetics resulting in a short residence time in the concentration balloon flask, close to 20 min. The concentration is entirely carried out under reduced pressure (25 mbar), bath temperature close to 90° C., product temperature close to 80° C. and vapor temperature close to 70° C.;
- slow kinetics resulting in a residence time in the concentration balloon flask close to 60 minutes. The concentration is only partially carried out under vacuum according to the following sequence (15 minutes without vacuum, bath and product temperature close to 90° C., little evaporation during this period; then 10 minutes at 500 mbar, bath and product temperature close to 90° C., little evaporation; then 10 minutes at 200 mbar, bath temperature 90° C.; then 25 mbar until the desired concentration is reached).

The results of the JBT AE centrifugation tests are collated in table III hereinafter.

TABLE III

Tests of centrifugation of various JBT AE-type beet juices resulting from the ECOSAF pilot

| Test | Sample nature | Centrifuge acceleration/time | BER 40 cellulose | Duration concentration & final Brix | Level of deposit | Observation |
|---|---|---|---|---|---|---|
| S4.1 | JBT AE | no | no | 20 min, 64° Bx | 13% | Internal control |
| S4.2 | JBT AE | 2700 g/5 min | no | 20 min, 62° Bx | 2% | Reduction in the |
| S4.3 | JBT AE | 2700 g/5 min | 0.5% | 20 min, 65° Bx | 2% | sludge level |
| S4.4 | JBT AE | 2700 g/5 min | 1% | 20 min, 66° Bx | 2% | with or without |
| S4.5 | JBT AE | 2700 g/5 min | 2% | 20 min, 63° Bx | 1% | cellulose |
| S4.6 | JBT AE | 4500 g/5 min | no | 20 min, 67° Bx | 2% | Reduction in the |
| S4.7 | JBT AE | 4500 g/5 min | 0.5% | 20 min, 63° Bx | 1% | sludge level |
| S4.8 | JBT AE | 4500 g/5 min | 1% | 20 min, 67° Bx | 1% | with or without |
| S4.9 | JBT AE | 4500 g/5 min | 2% | 20 min, 62° Bx | 1% | cellulose |
| S5.1 | JBT AE | no | no | 20 min, 63° Bx | 21% | Internal control |
| S5.2 | JBT AE | 2700 g/5 min | no | 20 min, 63° Bx | <0.5% | Reduction in the |
| S5.3 | JBT AE | 2700 g/5 min | 0.5% | 20 min, 64° Bx | <0.5% | sludge level |
| S5.4 | JBT AE | 2700 g/5 min | 1% | 20 min, 64° Bx | <0.5% | with or without |
| S5.5 | JBT AE | 2700 g/5 min | 2% | 20 min, 65° Bx | 1% | cellulose |
| S5.6 | JBT AE | 4500 g/5 min | no | 20 min, 66° Bx | <0.5% | Reduction in the |
| S5.7 | JBT AE | 4500 g/5 min | 0.5% | 20 min, 68° Bx | <0.5% | sludge level |

TABLE III-continued

Tests of centrifugation of various JBT AE-type beet juices resulting from the ECOSAF pilot

| Test | Sample nature | Centrifuge acceleration/time | BER 40 cellulose | Duration concentration & final Brix | Level of deposit | Observation |
|---|---|---|---|---|---|---|
| S5.8 | JBT AE | 4500 g/5 min | 1% | 20 min, 65° Bx | <0.5% | with or without |
| S5.9 | JBT AE | 4500 g/5 min | 2% | 20 min, 66° Bx | <0.5% | cellulose |
| S6.1 | JBT AE | no | no | 60 min, 66° Bx | 14% | Internal control |
| S6.2 | JBT AE | 1000 g/1 min | no | 60 min, 65° Bx | 1% | Reduction in the |
| S6.3 | JBT AE | 1000 g/1 min | 0.5% | 60 min, 64° Bx | 1% | sludge level |
| S6.4 | JBT AE | 1000 g/5 min | no | 60 min, 69° Bx | <0.5% | with or without |
| S6.5 | JBT AE | 1000 g/5 min | 0.5% | 60 min, 68° Bx | <0.5% | cellulose |
| S6.6 | JBT AE | 3000 g/1 min | no | 60 min, 68° Bx | <0.5% | Reduction in the |
| S6.7 | JBT AE | 3000 g/1 min | 0.5% | 60 min, 65° Bx | <0.5% | sludge level |
| S6.8 | JBT AE | 3000 g/5 min | no | 60 min, 65° Bx | <0.5% | with or without |
| S6.9 | JBT AE | 3000 g/5 min | 0.5% | 60 min, 65° Bx | <0.5% | cellulose |

The juices were centrifuged on a JOUAN KR4/22 centrifuge + RP6 rotor. The juice to be centrifuged can be topped up with JRS BER 40 cellulose fibers according to a ratio of 0.5% to 2% W/W. After centrifugation, the supernatants were concentrated on a rotary evaporator until a Brix close to 65% was obtained. The level of deposit was then measured according to the protocol of example 1.

The JBT AE centrifugation tests clearly show that all the conditions tested in the Pilot:

acceleration ranging from 1000 to 4500 g;

for a period of 1 to 5 minutes;

with or without use of cellulose;

followed by a more or less long concentration treatment;

sampling of JBT AE on ECOSAF pilot on three different days, result in total reduction of the level of deposit present in the JBT AE.

The invention claimed is:

1. A process for purifying beet sugar juice comprising:

(a) combining the beet sugar juice and cellulose fibers at a content of between 0.1% and 4% by weight; and, (b) passing the beet sugar juice and cellulose fiber combination through a filtration precoat which consists of 100% of cellulose fibers.

2. The process as claimed in claim 1, wherein the cellulose fiber content is preferentially between 0.2% and 3% by weight.

3. The process as claimed in claim 1, wherein the filtration is carried out by means of a scraped precoat rotary filter.

4. The process as claimed in claim 1, wherein the filtration is frontal.

5. The process as claimed in claim 1, wherein the filtration step is preceded by a centrifugation step.

* * * * *